United States Patent [19]

Saffer et al.

[11] Patent Number: 4,911,555

[45] Date of Patent: Mar. 27, 1990

[54] MAGNETIC STIRRER FOR MULTIPLE SAMPLES

[75] Inventors: Jeffrey D. Saffer; Louis A. Profenno, both of Ellsworth, Me.

[73] Assignee: The Jackson Laboratory, Bar Harbor, Me.

[21] Appl. No.: 347,068

[22] Filed: May 4, 1989

[51] Int. Cl.[4] ..... B01F 13/08

[52] U.S. Cl. ..... 366/274

[58] Field of Search ..... 366/273, 274, 127; 210/222

[56] References Cited

U.S. PATENT DOCUMENTS

| | | | |
|---|---|---|---|
| 3,088,716 | 5/1961 | Stott . | |
| 3,356,346 | 12/1967 | Landsberger . | |
| 3,384,353 | 5/1968 | Worth . | |
| 3,614,959 | 10/1971 | Schollmaier | 366/274 |
| 4,140,401 | 2/1979 | Paschal | 366/274 |
| 4,477,192 | 10/1984 | Bonney . | |
| 4,836,826 | 6/1989 | Carter | 366/274 |

*Primary Examiner*—Robert W. Jenkins

*Attorney, Agent, or Firm*—Daniel H. Kane, Jr.

[57] ABSTRACT

A magnetic stirrer provides controlled and uniform stirring of multiple samples in multiple sample containers containing a stirring magnet. An elongate armature of nonmagnetic material is mounted for rotation on a substantially vertical axis. A motor rotates the elongate armature. First and second drive magnets are mounted at opposite ends of the elongate arms. The drive magnets are oriented with the respective magnetic pole axes in opposite substantially vertical directions. The drive magnets describe a circumference of a circle in a plane upon rotation of the armature. Multiple samples in multiple sample containers are placed at locations spaced from the plane, either above or below, and offset from the circumference of the circle, either outside or inside, for uniform and controlled rotation of the stirring magnets contained in the sample containers. In an alternative embodiment, vertical stems are mounted at the ends of the elongate arm. Drive magnets are mounted on the stems with magnetic pole axes in opposite substantially horizontal radial directions. The stems, drive magnets and multiple samples are adjustable to different height positions for controlling the height position or elevation of stirring magnets in the respective samples.

18 Claims, 3 Drawing Sheets

MAGNETIC STIRRER FOR MULTIPLE SAMPLES

The United States Government has rights in this invention by reason of research and development support under Department of Defense Office of Naval Research Contract No. N000-14-87-K-0145.

TECHNICAL FIELD

This invention relates to magnetic stirrers for stirring samples in sample containers containing a stirring magnet. In particular, the invention provides a magnetic stirrer for simultaneously and uniformly stirring multiple samples such as chemical and biological samples.

Background Art

A chemical or biological sample in a standard sample tube or container may be stirred by placing a stirring magnet in the sample tube with the sample. The stirring magnet is typically a small stirring bar magnet encased in inert plastic with the magnetic pole axis oriented in the horizontal direction. In some stirring magnets, a stirring "ring" or "pivot ring" of plastic may be formed around the middle of the stirring bar magnet, raising the stirring bar magnet above the bottom of the sample tube. This facilitates rotation on a small surface area of the bottom of the sample tube and improves stirring of the sample.

In conventional magnetic stirrers, one motor mechanically rotates one horizontal drive bar magnet armature or rotor on a vertical axis of rotation. The rotating drive bar magnet armature in turn rotates the stirring magnet within a sample in a sample tube suspended over the motor and drive bar magnet. A sterile stirring magnet may be sealed with the sample in the sample tube or container. In this way the integrity of the sample is maintained, stirring the sample without breaking or invading the sample. The continuous stirring achieved by the magnetic stirrer also improves temperature control and temperature distribution in the sample. In the case of biological samples, for example, it evenly distributes bacteria in suspension.

A disadvantage of the conventional magnetic stirrers however is the limitation that one motor rotates one drive bar magnet which in turn rotates one sample stirrer. There is a magnetic stirrer unit by American Scientific Products (TM) and another by Bellco Biotechnology, Inc. (TM) in which one motor mechanically turns multiple horizontal drive bar magnets using an arrangement of drive belts. However each drive bar magnet in turn can rotate only one stirring magnet in a sample positioned over the rotating drive bar magnet.

The Bonney U.S. Pat. No. 4,477,192 describes a magnetic stirring apparatus and method in which "a plurality of moving magnetic fields . . . cause the magnetic stirring element to move erratically in the container." The erratic motion increases turbulence and mixing of the sample. The rotating magnetic fields are produced by multiple permanent magnets arranged on a rotor. The magnets are arranged end to end with elongate magnetic pole axes oriented in the horizontal direction and with like poles adjacent to each other. The end to end bar magnets may be arranged in a variety of configurations around the axis of rotation of the rotor. The multiple rotating magnetic fields can be used for stirring multiple samples. However because of the arrangement of opposing fields and resulting erratic motion of the stirring magnets in the samples, the Bonney magnetic stirrer is not able to assure controlled uniform stirring of multiple samples. Furthermore, the erratic motion of the stirring magnets prevents high speed stirring and limits the range of stirring speeds.

The Worth U.S. Pat. No. 3,384,353 describes a magnetic stirrer in which the magnetic fields of the rotor are provided by horizontal shallow U-shaped horseshoe magnets instead of bar magnets. It appears that the Worth magnetic stirrer is similarly limited to mixing one sample at a time. The Stott U.S. Pat. No. 3,088716 describes another magnetic stirrer using an elongate or shallow horseshoe magnet on the rotor. However, one pole is located at the axis of rotation while the other is positioned at the circumference of rotation The Landsberger U.S. Pat. No. 3,356,346 describes a magnetic stirrer for stirring multiple samples. The rotor or armature in the apparatus is a conventional horizontal bar magnetic rotating on a vertical axis at its midpoint. This conventional rotor is able to stir multiple samples because the stirring magnets in the sample tubes are oriented with the magnetic pole axis in the vertical direction. The stirring magnets are confined in the sample tubes in this vertical orientation. The rotating magnetic fields of the conventional rotor push and pull the stirring magnets in a vertical direction up and down in the sample tubes for 20 vertical stirring.

OBJECTS OF THE INVENTION

It is therefore an object of the present invention to provide a magnetic stirrer in which a single drive motor and magnetic field armature or rotor stirs multiple samples in multiple sample containers using conventional stirring magnets contained in the sample containers.

Another object of the invention is to provide a magnetic stirrer which provides controlled and uniform stirring of the multiple samples and which is particularly useful for stirring chemical and biological samples.

DISCLOSURE OF THE INVENTION

In order to accomplish these results the invention provides a magnetic stirrer for stirring samples in sample containers containing a stirring magnet having the magnetic pole axis of the stirring magnet oriented in a substantially horizontal direction. An elongate horizontal arm or armature of non-magnetic material is mounted for rotation on a substantially vertical axis. A motor rotates the elongate arm on the vertical axis.

According to the invention first and second drive magnets are mounted respectively at opposite ends of the elongate arm. The drive magnets have magnetic pole axes oriented respectively in opposite, substantially vertical directions. That is, the first drive magnet is mounted at one end of the elongate arm with magnetic pole axis oriented in a substantially vertical direction and with the north pole above the south pole. The second drive magnet is mounted at the other end of the elongate arm with magnetic pole axis oriented in a substantially vertical direction and with the south pole above the north pole.

The first and second drive magnets describe a circumference of a circle in a plane upon rotation of the elongate arm. A feature of this configuration and spatial relationship of the drive magnets is that multiple samples can be placed at locations spaced from said plane, either above or below, and offset from the circumference of the circle, either inside or out, with resulting controlled and uniform rotation of the stirring magnets in multiple samples. Thus, multiple samples are positioned above or below the plane of the circle described by the first and second drive magnets. Furthermore, the multiple samples are placed at locations in circular or annular bands of space coaxial with the circle and vertical axis of rotation. The circular or annular bands are offset or spaced from the circumference of the circle described by the first and second drive magnets, either inside or outside the circumference of the circle.

Effectively only a single pole of each drive magnet is used to drive the stirring magnets. For samples positioned above the plane of the circle, stirring is effected by the vertically upper pole only of each drive magnet. For samples positioned below the plane of the circle, the lower poles of the drive magnets cause the stirring magnets to turn.

In the preferred example, the magnetic stirrer is used in association with a sample container holding or suspending apparatus which positions the multiple sample tubes or containers above the plane of the circle described by the drive magnets, and within a circular band of space coaxial with the circle. The circular band is positioned between the circumference of the circle and the vertical axis of rotation. For example the magnetic stirrer may be positioned beneath a temperature controlled bath in which the sample tubes are suspended at locations which fall within the circular band of space between the circumference of the circle and the center of the circle described by the rotating drive magnets. Only the upper poles of each vertically oriented drive magnet drive or turn the stirring magnet in each sample.

Controlled and uniform stirring of the multiple samples according to the invention is intended to refer to the rotation of each stirring magnet within the sample tubes at the same rate of rotation. Furthermore, controlled and uniform stirring as used herein refers to maintaining substantially uniform vertical angular orientation of the respective stirring magnets during rotation. That is, uniform stirring maintains a substantially uniform angle of the respective stirring magnets relative to a vertical axis or vertical direction. The combination of equal rates of rotation and substantially uniform vertical angular orientation assures that each sample of the multiple samples stirred by the magnetic stirrer receives substantially the same physical treatment. This factor may be important in the stirring and handling of multiple chemical and biological samples.

The first and second drive magnets may be adjustably mounted at the ends of the elongate arm for changing the mounting positions of the drive magnets along the generally horizontal elongate arm at the respective ends. In this manner the radius of the circumference of the circle described by the drive magnets upon rotation of the arm may be varied to accommodate different sample container holder, mounting and suspension systems.

The invention thus provides a method of stirring samples in multiple sample containers by rotating first and second independent magnetic fields around the circumference of a circle in a plane and spacing the first and second independent magnetic fields approximately 180° out of phase around the circumference of the circle. The respective spaced apart independent magnetic fields are oriented with the respective magnetic pole axes in opposite substantially vertical directions. The invention further contemplates the steps of positioning samples in sample containers at locations spaced from the plane and offset from the circumference of the circle for uniform stirring of multiple samples by stirring magnets contained in the respective sample containers. The stirring magnets in the samples are of the conventional type with magnetic pole axes oriented in the horizontal direction. In the preferred method the samples are typically positioned above the plane of the circle of rotation of the magnetic fields in a circular band of space coaxial with the circle and between the circumference and center of the circle.

In an alternative embodiment of the invention, the horizontal elongate arm or armature of non-magnetic material is mounted for rotation in a horizontal plane on a substantially vertical axis. A motor rotates the elongate arm on the vertical axis. First and second vertical stems are mounted at the ends of the elongate arm projecting upward from the arm.

According to the invention first and second drive magnet are mounted respectively on the stems, raised above the opposite ends of the elongate arm. The drive magnets have magnetic pole axes oriented respectively in opposite, substantially horizontal and radial directions. That is, the first drive magnet is mounted on the first stem above one end of the elongate arm with magnetic pole axis oriented in a substantially horizontal direction and with the north pole radially inside the south pole. The second drive magnet is mounted on the second stem above the other end of the elongate arm with magnetic pole axis oriented in a substantially horizontal direction and with the south pole radially inside the north pole.

The first and second drive magnets describe a circumference of a circle in a plane upon rotation of the elongate arm. A feature of this configuration and spatial relationship of the drive magnets is that multiple samples can be placed at locations intersecting the plane of the circle at different elevations relative to the circle and inside the circumference of the circle. As a result, there is controlled and uniform rotation of the stirring magnets in multiple samples at the desired elevations within the samples. Thus, multiple samples are positioned at a selected variable height relative to the plane of the circle described by the first and second drive magnets for setting and controlling the elevation of the stirring magnets in the samples. Effectively only a single pole of each drive magnet, the radially inwardly directed pole, is used for driving the stirring magnets and for maintaining and holding the stirring magnets at the same elevation as the drive magnets relative to the sample inside the sample container.

The first and second drive magnets may be adjustably mounted on the vertical stems, or the stems may be vertically adjustable on the ends of the elongate arm for changing the mounting position height of the drive magnets on the respective stems above the respective ends of the arm. Alternatively, the sample tubes or containers may be raised and lowered to different mounting positions in the vertical direction. In this manner the vertical height position of the magnetic stirrers in the samples may be controlled at different elevations.

Other objects, features and advantages of the invention are apparent in the following specification and accompanying drawings.

DESCRIPTION OF PREFERRED EXAMPLE EMBODIMENTS AND BEST MODE OF THE INVENTION

Figure 1:
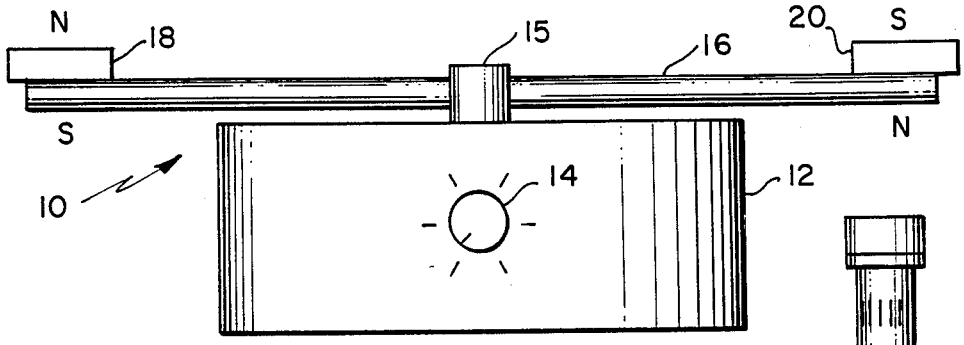
FIG. 1 is a side view of the magnetic stirrer for stirring multiple samples.
Figure 2:
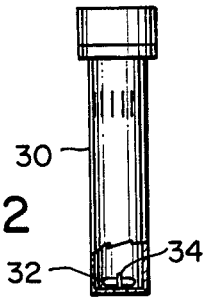
FIG. 2 is a side view partially cut away of a conventional sample tube showing a conventional stirring magnet resting on its pivot ring in the sample at the bottom of the sample container.
Figure 3:
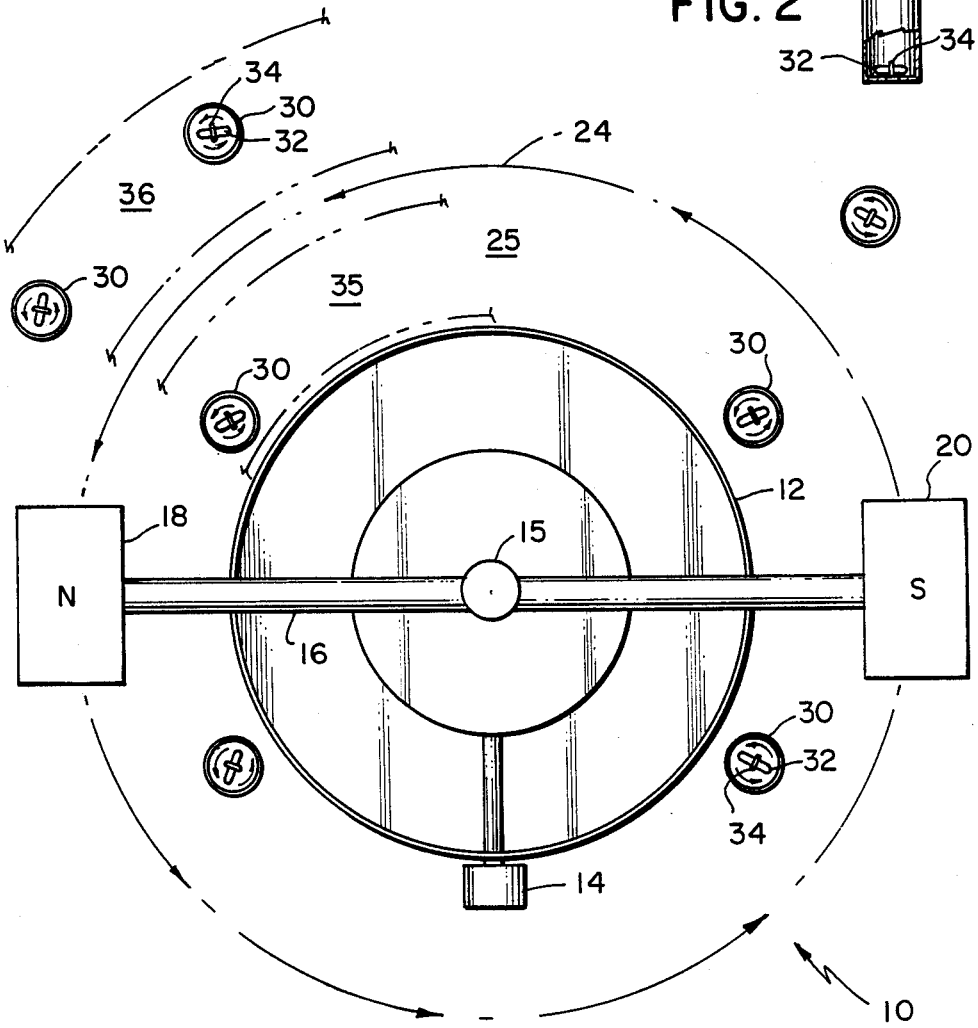
FIG. 3 is a plan view of the magnetic stirrer showing multiple sample tubes positioned at locations within circular bands both outside and inside the circumference of the circle described by the rotating drive magnets.

A magnetic stirrer 10 according to the invention is illustrated in FIGS. 1–3. A drive motor 12 with variable speed control 14 rotates the vertical drive post or drive shaft 15 which provides a vertical axis of rotation. The elongate arm or armature 16 is mounted for rotation on the vertical axis 15 for rotation in a generally horizontal plane.

Permanent magnets 18 and 20 provide the drive magnets mounted at the respective ends of the armature 16. The armature 16 is made of non-magnetic, non-permeable material such as a plastic or fiberglass rod so that it does not interfere in the spaced apart, independent magnetic fields provided by the drive magnets 18 and 20. The drive magnets 18 and 20 are mounted at the respective ends of non-magnetic armature 16 with the respective magnetic north-south pole axes oriented in opposite but vertical directions. Thus permanent magnet 18 is mounted with its north-south pole axis oriented vertically with north above and south below. Permanent magnet 20 is mounted with its north-south pole axis oriented vertically with south above and north below.

As a result of the spatial as well as the impermeable or non-permeable separation of drive magnets 18 and 20 by armature 16, the vertically oriented magnetic fields generated by the drive magnets 18 and 20 are truly independent, for independently interacting with stirring magnets in samples upon rotation of the armature 16 as hereafter described. Only a single pole of each drive magnet interacts with a stirring magnet for turning the stirring magnet in a sample. For samples positioned above the plane of rotation it is the upper pole of each drive magnet while for samples positioned below the plane of rotation it is the lower poles. Drive magnets 18 and 20 may be bonded at the ends of the rod armature 16 or may be slidably mounted, for example, on a slidable sleeve for variable positioning on the rod armature 16. In this manner the effective radius of the circle swept by the drive magnets upon rotation of the armature 16 can be varied to accommodate different sample holders.

Upon rotation of the rotor or armature 16, the drive magnets 18 and 20 describe or circumscribe the circumference 24 of a circle 25 lying in a plane, which in the example illustrated in FIG. 3 is approximately the plane of the paper. Sample containers 30 are then positioned in relation to the circle 25 for controlled and uniform stirring of stirring magnets 32 contained in the sample containers. Sample containers 30 are spaced from the plane of the circle 25 either above or below the plane, and offset from the circumference 24 of the circle described by the rotating drive magnets 18,20. Preferably the sample containers 30 are positioned in a circular band of space 35 positioned inside the circumference 24 between the circumference 24 and the vertical axis of rotation 15. Alternatively, the sample containers 30 can be positioned in a circular band of space 36 located outside the circumference 24 of the circle 25. This placement of the sample containers 30 provides optimum positioning for controlled and uniform interaction of the magnetic fields of the drive magnets 18 and 20 with the stirring magnets. In this example, the stirring magnets 32 are sealed with the samples inside the sample containers 30.

Thus, the relative positioning illustrated in FIG. 3 assures a uniform rotation of all of the stirring magnets 32 of the multiple samples at the same rate, and with the same angular orientation of the stirring magnets 32 in the vertical direction. As a result similar controlled and uniform physical processing can be maintained for all of the multiple samples.

As shown in FIGS. 2 and 3 each of the stirring magnets 32 is a small elongate bar magnet enclosed or encased in an inner plastic. In the illustrated examples, the enclosing plastic is formed with a pivot ring 34 which raises the stirring magnet from the bottom surface and permits rotation of the stirring magnet on a small contact surface area.

Figure 4:
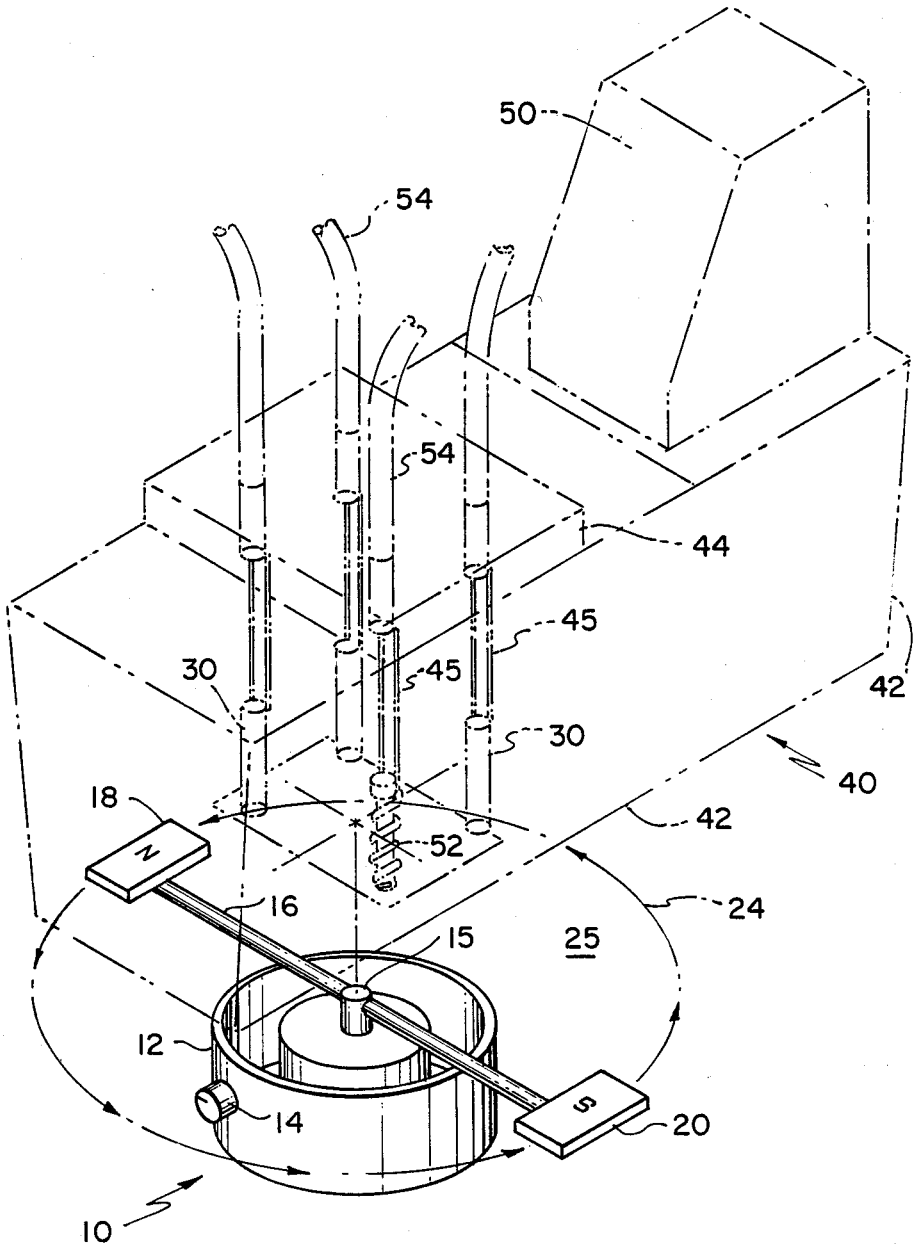
FIG. 4 is a perspective view of the magnetic stirrer positioned below a sample container holding or suspension system including a temperature controlled bath shown in phantom outline.

A particular example application of the stirrer is illustrated in FIG. 4. The magnetic stirrer 10 is positioned below a temperature control bath such as an oil bath 40 in which sealed sample tubes 30 are suspended. The temperature control oil bath 40 includes a reservoir 42 containing a circulating temperature control liquid such as water or oil. The sample tubes 30 are rigidly mounted and suspended from a block 44 in turn mounted on top of the reservoir 42. The rigid suspending elements 45 position the sample containers 30 in the temperature control bath t locations above the plane of the circle 25 swept by the armature 16 and drive magnets 18,20. In this arrangement only the single upper pole of each drive magnet interacts with the magnetic stirrers for turning the stirrers in the samples. Furthermore, the positioning locations in the block 44 place the sample containers 30 at locations inside the circumference 24 of the circle 25 and within the circular band of space 35 between the circumference 24 and the vertical axis of rotation 15 which also coincides with the center of circle 25.

The temperature control bath 40 may include a liquid circulating and temperature control unit 50. In the example of FIG. 4, the sample containers are being subject to, for example, microwave irradiation through microwave antenna sample container holders 52, only one of which is shown. Microwave electromagnetic energy is delivered through the coaxial transmission lines 54 to the rigid suspending antenna leads 45 which couple the transmission lines 54 to the microwave antenna sample container holders 52.

In this particular example in which microwave irradiation is being used, the temperature control medium in reservoir 42 is in oil such as transformer oil. Further description of the temperature control oil bath and microwave irradiation system for suspending, holding and treating multiple samples is described in the related U.S. Patent Application Serial No. 347,066 entitled MICROWAVE SAMPLE IRRADIATION SYSTEM May 4, 1989 filed by the same applicants and assigned to the same assignee. The magnetic stirrer 10 is of course applicable for stirring multiple samples in any sample tube or sample container mounting, holding or suspension system. The magnetic stirrer 10 is typically positioned below sample container mounting apparatus.

Figure 5:
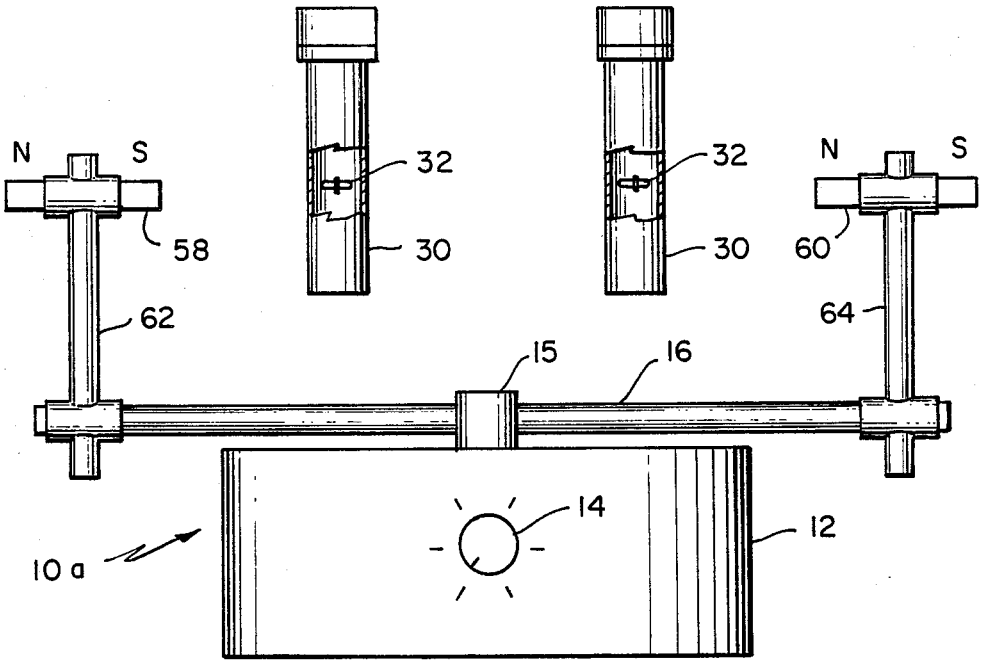
FIG. 5 is a side view of an alternative magnetic stirrer for stirring multiple samples according to the invention.

An alternative magnetic stirrer 10*a* according to the invention is illustrated in FIG. 5. A drive motor 12 with variable speed control 14 rotates the vertical drive post or drive shaft 15 which provides a vertical axis of rotation. The elongate arm or armature 16 is mounted for rotation on the vertical axis 15 for rotation in a generally horizontal plane.

Permanent magnets 58 and 60 provide the drive magnets mounted on the respective vertical stems 62,64 secured to the ends of the armature 16. The armature 16 and stems 62,64 are made of non-magnetic, non-permeable material such as plastic or fiberglass rods so that they do not interfere in the spaced apart, independent magnetic fields provided by the drive magnets 58 and 60. The drive magnets 58 and 60 are mounted on the vertical stems above the respective ends of non-magnetic armature 16 with the respective magnetic north-south pole axes oriented in opposite but horizontal radial directions. Thus permanent magnet 58 is mounted with its north-south pole axis oriented in a radial horizontal direction with north radially outside and south radially inside. Permanent magnet 60 is mounted with its north-south pole axis oriented in a radial horizontal direction with south radially outside and north radially inside.

As a result of the spatial as well as the impermeable separation of drive magnets 58 and 60 by armature 16 and stems 62,64, the horizontally oriented magnetic fields generated by the drive magnets 58 and 60 are truly independent, for independently interacting with stirring magnets upon rotation of the armature 16 as hereafter described. The drive magnets 58,60 not only turn the stirring magnets 32 but also hold the stirring magnets at a specified vertical position or elevation within the sample spaced above the bottom of the sample container as shown in FIG. 5. Drive magnets 58 and 60 may be slidably mounted, for example, on a slidable sleeve for variable positioning on the stems 62,64. Alternatively, the stems 62,64 may be slideable in brackets on the elongate arm 16 to different vertical positions, or the sample tubes 30 may be raised and lowered. In this manner the effective stirring magnet height position in the samples may be varied.

It is only one pole of each of the drive magnets 58,60, namely the radially inward pole, that is effective to turn the stirring magnets and to hold the stirring magnets at the specified elevation position within the samples. In the example of FIG. 5, the magnetic axes are oriented horizontally so that the operative poles are able to hold the stirring magnets at the specified vertical height position.

Upon rotation of the rotor or armature 16, the drive magnets 58 and 60 describe or circumscribe the circumference of a circle lying in a plane, which in the example illustrated in FIG. 5 is approximately perpendicular to the plane of the paper. Sample containers 30 are then positioned in relation to the circle intersecting the circle for controlled and uniform stirring of stirring magnets at the desired elevation within the samples contained in the sample containers. Sample containers 30 are positioned at a desired height intersecting the plane of the circle 25 and extending above and below the plane. The samples are also offset from the circumference of the circle described by the rotating drive magnets 58,60 and positioned inside the circle. This placement of the sample containers 30 provides optimum positioning for controlled and uniform interaction of the magnetic fields of the drive magnets 58 and 60. The stirring magnets 32 may be sealed within the samples inside the sample containers 30.

Thus, the relative positioning illustrated in FIG. 5 assures a uniform rotation of all of the stirring magnets 32 of the multiple samples at the same rate, with the same angular orientation of the stirring magnets 32 in the horizontal direction and with the same selected height position within the sample. As a result similar controlled and uniform physical processing can be maintained for all of the multiple samples.

While the invention has been described with reference to particular example embodiments it is intended to cover all modifications and equivalents within the scope of the following claims.

We claim:

1. A magnetic stirrer for stirring samples in sample containers containing a stirring magnet having the magnetic pole axis of the stirring magnet oriented in a substantially horizontal direction comprising:

an elongate arm of non-magnetic material mounted for rotation on a substantially vertical axis;

motor means for rotating the elongate arm on the substantially vertical axis;

first and second drive magnets mounted respectively at opposite ends of the elongate arm, said drive magnets having their respective magnetic pole axes oriented in opposite substantially vertical directions;

said drive magnets describing a circumference of a circle in a plane upon rotation of the elongate arm so that multiple samples in sample containers can be placed at locations spaced from said plane and offset from the circumference of the circle for uniform drive rotation of the stirring magnets contained in the sample containers.

2. The magnetic stirrer of claim 1 wherein the first and second drive magnets are adjustably mounted at the ends of the elongate arm for changing the mounting positions of the drive magnets along the elongate arm at the respective ends for changing the radius of the circumference of a circle described by said drive magnets upon rotation of the elongate arm.

3. The magnetic stirrer of claim 1 further comprising sample container positioning means for positioning sample containers at locations spaced from the plane of the circle and offset from the circumference of the circle.

4. The magnetic stirrer of claim 3 wherein the sample container positioning means is constructed and arranged to position sample containers above the plane of the circle described by the rotating drive magnets and at locations within a circular band of space coaxial with the circle and spaced between the circumference of said circle and the substantially vertical axis of rotation of the elongate arm.

5. The magnetic stirrer of claim 4 comprising multiple sample containers positioned at locations above the plane and within a circular band coaxial with the circle and spaced between the circumference of said circle and the substantially vertical axis of rotation of the elongate arm.

6. The magnetic stirrer of claim 3 comprising a plurality of sample containers positioned at locations spaced from said plane and offset from the circumference of said circle.

7. A magnetic stirrer for stirring samples in sample containers containing a stirring magnet having the magnetic pole axis of the stirring magnet oriented in a substantially horizontal direction comprising:

an elongate arm of non-magnetic material mounted for rotating on a substantially vertical axis;

motor means for rotating the elongate arm on the substantially vertical axis;

a first drive magnet mounted at one end of the elongate arm, said first drive magnet having a magnetic pole axis oriented in a substantially vertical direction with the north pole above the south pole;

a second drive magnet mounted at the other end of the elongate arm said second drive magnet having a magnetic pole axis oriented in a substantially vertical direction with the south pole above the north pole;

said first and second drive magnets describing a circumference of a circle in a plane upon rotation of the elongate arm;

and sample container positioning means for positioning sample containers at locations spaced from the plane of the circle and offset from the circumference of the circle for controlled uniform rotation of stirring magnets in multiple samples contained in multiple sample containers.

8. The magnetic stirrer of claim 7 further comprising a plurality of sample containers positioned at locations spaced from said plane and offset from the circumference of said circle.

9. The magnetic stirrer of claim 7 further comprising multiple sample containers positioned at locations above the plane and within a circular band coaxial with the circle described by rotation of the drive magnets and between the circumference of said circle and the substantially vertical axis of rotation of the elongate arm.

10. A method for stirring samples in sample containers containing a stirring magnet having a magnetic pole axis oriented in a substantially horizontal direction comprising:

rotating first and second independent magnetic fields around the circumference of a circle in a plane, spacing the first and second independent magnetic fields approximately 180° out of phase around the circumference of said circle, and orienting the first and second independent magnetic fields with respective magnetic pole axes in opposite substantially vertical directions; and positioning samples in sample containers at locations spaced from the plane and offset from the circumference of the circle for uniform stirring of multiple samples by stirring magnets contained in the sample containers.

11. The method of claim 10 comprising the step of positioning the samples in sample containers in a circular band of space coaxial with the circle and between the circumference and the center of said circle.

12. A method of stirring samples in sample containers containing a stirring magnet having the magnetic pole axis of the stirring magnet oriented in a substantially horizontal direction comprising:

rotating first and second drive magnets mounted at the opposite ends of an elongate non-magnetic armature by rotating the armature on a substantially vertical axis, said drive magnets describing the circumference of a circle in a plane, said first and second drive magnets having the respective magnetic pole axes oriented in opposite substantially vertical directions;

and positioning multiple samples in multiple sample containers at locations spaced from the plane of the circle described by the rotating drive magnets and offset from the circumference of the circle for controlled and uniform stirring of multiple samples in the multiple sample containers.

13. The method of claim 12 comprising the step of positioning the multiple samples in multiple sample containers above the plane of the circle described by the rotating drive magnets in a circular band of space coaxial with said circle between the circumference of the circle and the substantially vertical axis of rotation of said armature.

14. A magnetic stirrer for stirring samples in sample containers containing a stirring magnet having the magnetic pole axis of the stirring magnet oriented in a substantially horizontal direction comprising:

an elongate arm of non-magnetic material mounted generally horizontally for rotation on a substantially vertical axis;

motor means for rotating the elongate arm on the substantially vertical axis;

first and second vertical stems mounted at the ends of the elongate arm and projecting upward from said arm;

first and second drive magnets mounted respectively on the vertical stems above the ends of the elongate arm, said drive magnets having their respective magnetic pole axes oriented in opposite substantially horizontal radial directions;

said drive magnets describing a circumference of a circle in a plane upon rotation of the elongate arm so that multiple samples in sample containers can be placed at locations intersecting the circle and offset from the circumference within the circle for uniform drive rotation of the stirring magnets contained in the sample containers at a specified elevation within the sample.

15. The magnetic stirrer of claim 14 wherein the first and second drive magnets are adjustably mounted on the vertical stems at the ends of the elongate arm for changing the vertical mounting positions of the drive magnets for changing the elevation of stirring magnets in the samples.

16. The magnetic stirrer of claim 14 further comprising sample container positioning means for positioning sample containers at locations inside the circumference of the circle at different height positions for varying the elevation of stirring magnets in the respective samples.

17. The magnetic stirrer of claim 16 wherein the sample container positioning means is constructed and arranged to position sample containers at different elevations intersecting the circle described by the rotating drive magnets and at locations within a circular band of space coaxial with the circle and spaced between the circumference of said circle and the substantially vertical axis of rotation of the elongate arm.

18. The magnetic stirrer of claim 16 comprising a plurality of sample containers positioned at locations within the circumference of said circle and at a selected elevation intersecting said circle for setting the elevation of stirring magnets in the respective samples.

* * * * *